US006131249A

United States Patent [19]

Suenaga

[11] Patent Number: 6,131,249

[45] Date of Patent: Oct. 17, 2000

[54] BELT CONNECTING DEVICE

[75] Inventor: Tomohiro Suenaga, Nara-ken, Japan

[73] Assignee: YKK Corporation, Tokyo, Japan

[21] Appl. No.: 09/306,334

[22] Filed: May 6, 1999

[30] Foreign Application Priority Data

May 11, 1998 [JP] Japan ..... 10-127599

[51] Int. Cl.[7] ..... A44B 11/25; A44B 18/00

[52] U.S. Cl. ..... 24/306; 24/68 E; 24/168; 24/442

[58] Field of Search ..... 24/306, 442, 182, 24/168, 615, 625, 634, 68 E

[56] References Cited

U.S. PATENT DOCUMENTS

| | | | |
|---|---|---|---|
| 1,347,827 | 7/1920 | Raymed | 24/168 |
| 2,648,112 | 8/1953 | Neumann | 24/168 |
| 4,005,506 | 2/1977 | Moore . | |
| 4,149,540 | 4/1979 | Hasslinger . | |
| 4,854,015 | 8/1989 | Shaull . | |
| 4,918,790 | 4/1990 | Cirket et al. | 24/442 |
| 5,201,100 | 4/1993 | Cardinale . | |
| 5,203,053 | 4/1993 | Rudd | 24/306 |
| 5,237,988 | 8/1993 | McNeese | 24/306 |
| 5,548,878 | 8/1996 | Romagnoli | 24/306 |
| 5,727,337 | 3/1998 | Okajima | 24/306 |

FOREIGN PATENT DOCUMENTS

| | | |
|---|---|---|
| 525 637 | 7/1972 | Switzerland . |
| 121880 | 1/1919 | United Kingdom . |

*Primary Examiner*—Victor N. Sakran
*Attorney, Agent, or Firm*—Hill & Simpson

[57] ABSTRACT

The present invention provides a belt connecting device which can be applied to various uses, has an excellent design property, and can be safely and easily operated even by elderly people and infants. The belt connecting device comprises a belt connecting member fixed to one portion of an article and a belt including one end portion fixed to another portion of the article. A female surface fastener is sewn on the other end portion of the belt to constitute an engaging portion to be engaged with the belt connecting member. The belt connecting member has at one end thereof an inserting hole through and to which the portion of the article is inserted and fixed, at the other end an engaged portion of a male surface fastener and with which the engaging portion of the belt detachably engages, and between the inserting hole and the engaged portion a belt threading portion comprising an elongated hole which is slightly longer than a width of the belt.

16 Claims, 8 Drawing Sheets

BELT CONNECTING DEVICE

BACKGROUND OF THE INVENTION

1. Field of the Invention

The present invention relates to a belt connecting device having a length adjusting function of an adjusting device for adjusting a size of an opening of a cap, a glove, or the like, or of a waist adjuster, and more specifically to a belt connecting device comprising a belt connecting member fixed to an article and a belt fixed to a portion of the article and engaged with the belt connecting member.

2. Description of the Related Art

Conventionally, a belt connecting device for adjusting a distance between two different portions to engage the portions with each other is employed in various articles. There is a cap as disclosed in Japanese Utility Model Publication No. 37-21627, for example, wherein an opening of a back of the cap is partially cut, a flap having a male surface fastener is mounted to one side of the cut portion, a female surface fastener is mounted to a rear face side of the other side of the cut portion, and the male surface fastener and the female surface fastener are engaged with each other, thereby closing the cut portion. In this cap, an opening degree of the cut portion can be adjusted to adjust a size of an opening of the cap according to a size of a user.

There is also gloves as disclosed in Japanese Utility Model Laid-open Application No. 57-5266, wherein a slit is formed at a portion of an inserting opening such that an opening degree of the inserting opening can be adjusted. An ellipse ring made of metal is attached by sewing to one side of the slit. On the other side of the slit, either half portion of a flap having a male surface fastener on its half portion and a female surface fastener on its the other half portion is sewn on a back of the glove. In this glove, the flap is inserted through the ellipse ring and is folded back after a hand is inserted into the glove through the inserting opening. Then, the male surface fastener and the female surface fastener are engaged with each other while adjusting a fastening degree of the inserting opening, thereby closing the slit.

However, a design of the belt connecting device is required to be improved due to a recent diversification in design. Also, use of the belt connecting device has been diversified, and a development of a belt connecting device not only with a design property but also with various functions such as a function to allow elderly people and infants to easily and safely engaging and disengaging the device is desired in order to employ the belt connecting device at a fly portion of clothes instead of a button.

SUMMARY OF THE INVENTION

The present invention has been accomplished to meet the above requirements, and it is an object of the invention to provide a belt connecting device which can be applied to various uses, has an excellent design property, and which can be safely and easily operated by the elderly people and infants.

To achieve the above object, according to the invention, there is provided a belt connecting device, as a main structure of the invention, which comprises a belt connecting member fixed to one portion of an article and a belt having one end portion fixed to another portion of the article and the other end portion inserted through and engaged with the belt connecting member and which has a function of adjusting a length of the belt connecting device in an engaged state. The belt includes at the other end portion thereof an engaging portion to be engaged with the belt connecting member, and the belt connecting member includes at one end thereof with a fixing portion to be fixed to the article, at the other end an engaged portion with which the engaging portion of the belt detachably engages, and a belt threading portion between the fixing portion and the engaged portion.

It is preferable that the belt threading portion is an elongated hole which is slightly longer than a width of the belt. The other end portion of the belt is inserted through the elongated hole, and folded back, and the engaging portion formed at the other end portion is engaged with the engaged portion of the belt connecting member while adjusting a length so as to connect and fix the belt. If the belt connecting device is used for clothes for elderly people and infants, it is preferable that one end of the elongated hole is cut off to facilitate insertion of the belt through the belt threading portion, and it is further preferable that a projection for preventing slipping off of the belt is formed at an edge of the cut end of the elongated hole.

It is preferable that the fixing portion has an inserting hole through which the one portion of the article can be inserted, or that the fixing portion comprises upper and lower clamping portions for clamping and fixing the one portion of the article. If the fixing portion comprises the upper and lower clamping portions, it is preferable that the fixing portion has a thin recessed groove for sewing so as to further reliably clamp and fix the article.

If each of the engaging portion and the engaged portion comprises a male or female surface fastener such that the engaging portion and the engaged portion can be engaged with and disengaged from each other, an engaging operation can be carried out only by pressing the male and female surface fasteners against each other, and thus, even the elderly people and infants can safely and easily operate the device. In this case, the belt may have either the male or female surface fastener being adjacent to the engaging portion, which can be engaged with and disengaged from the engaging portion and which is the same kind of fastener as the engaged portion. If such a structure is employed, because the end portion of the belt is engaged with the male or female surface fastener of the belt, the end portion does not hang down, thereby further improving an appearance. If a surface fastener integrally woven or knitted into the engaging portion of the belt in weaving/knitting is employed, the surface fastener may be integrally formed simultaneously with weaving/knitting of the belt body.

If each of the engaging portion and the engaged portion comprises a surface fastener where mixed male and female engaging elements which can engage with each other exist, the end portion of the belt does not hang down and is engaged with and fixed to both the engaged portion of the connecting member and the engaging portion of the belt. In addition, it is not necessary to especially select the male or female surface fastener when the surface fastener is mounted to the engaging portion or the engaged portion.

If the engaged portion of the belt connecting member comprises a male surface fastener, the belt connecting member including the engaged portion may be integrally molded by using synthetic resin. If the engaged portion of the belt connecting member and the engaging portion of the belt comprise surface fasteners woven/knitted into woven/knitted fabrics, the surface fasteners are mounted by sewing or by bonding using an adhesive.

DETAILED DESCRIPTION OF THE PREFERRED EMBODIMENTS

Figure 1:
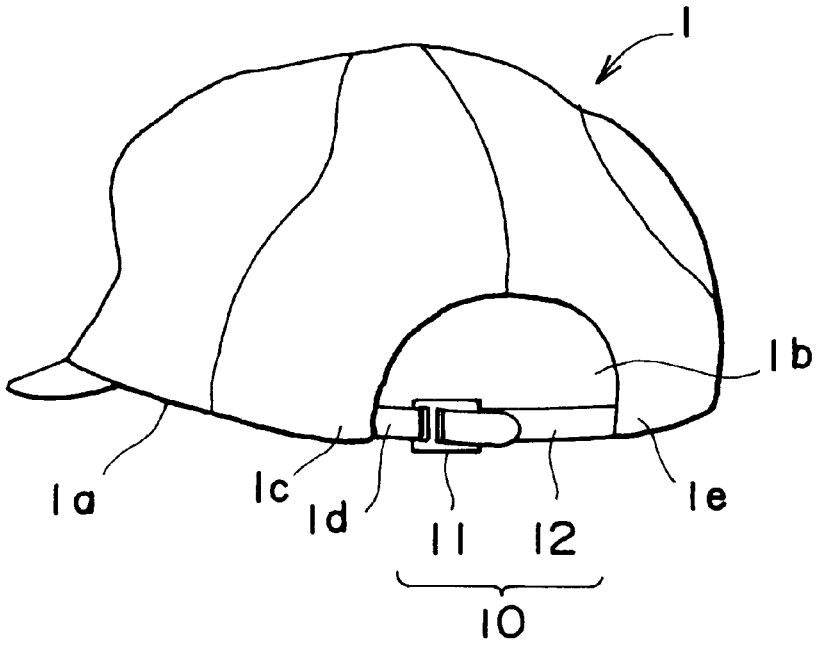
FIG. 1 is a rear view of a cap provided with a belt connecting device according to a first embodiment of the present invention.
Figure 2:
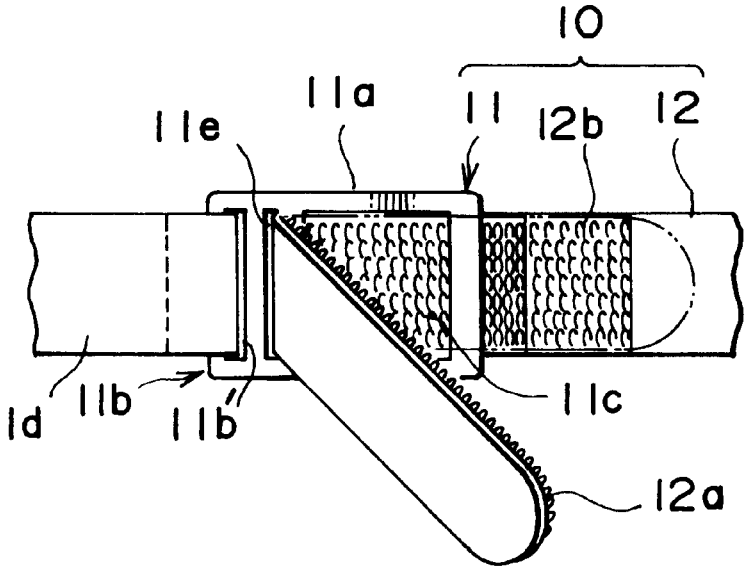
FIG. 2 is a front view of the belt connecting device.
Figure 3:
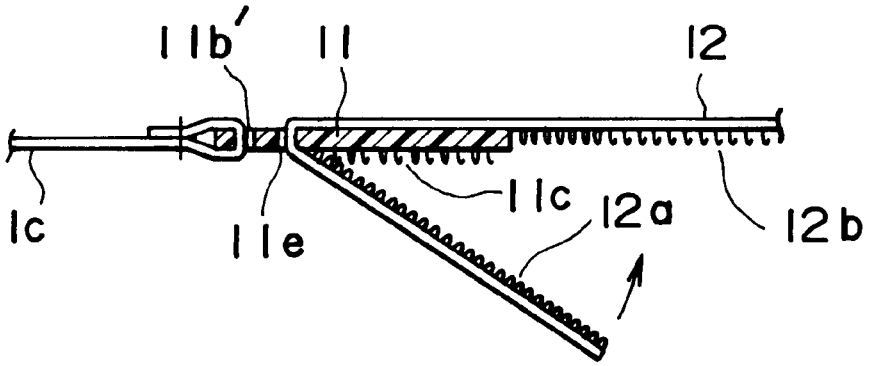
FIG. 3 is a sectional view of the connecting device.
Figure 4:
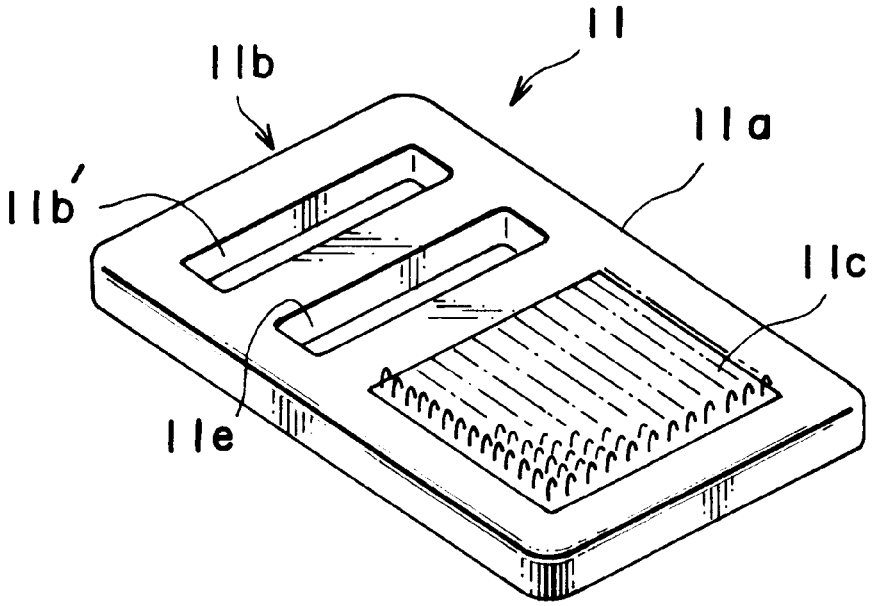
FIG. 4 is a perspective view of a belt connecting member of the belt connecting device.
Figure 5:
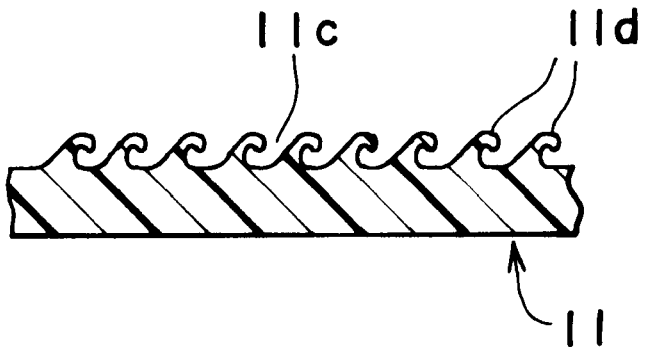
FIG. 5 is a fragmentary sectional view of the connecting member.

Preferred embodiments of the present invention will be specifically described below with reference to the accompanying drawings. FIG. 1 is a rear view of a cap provided with a belt connecting device according to a first embodiment of the invention. FIG. 2 is a front view of the belt connecting device. FIG. 3 is a sectional view of the connecting device. FIG. 4 is a perspective view of a belt connecting member of the belt connecting device. FIG. 5 is a fragmentary sectional view of the connecting member.

A window portion 1*b* is formed by cutting off a back portion of a cap 1 from a peripheral edge of an opening 1*a* to have a semicircular shape. The belt connecting device 10 according to the embodiment is mounted to the window portion 1*b* along the opening 1*a* of the cap 1. The belt connecting device 10 comprises a belt connecting member 11 fixed to a belt-shaped body 1*d* sewn on a corner portion 1*c* of the window portion 1*b* of the cap 1 and a belt 12 fixed by sewing with one end portion thereof to the other corner portion 1*e* of the window portion 1*b*.

An engaging portion 12*a* is formed on a surface of the belt 12 to extend from the other end portion opposite to the fixed end portion of the belt 12 to have a predetermined length. The engaging portion 12*a* is composed of a female surface fastener and is integrally secured to the belt 12 by bonding by using an adhesive or by sewing. Alternatively, the female surface fastener may be woven or knitted into the belt 12 at the time of weaving/knitting of the belt 12 so as to integrally form the engaging portion 12*a* simultaneously with weaving/knitting of the belt 12. Furthermore, a male surface fastener 12*b* is integrally secured to the belt 12 by bonding by using an adhesive or by sewing such that the male surface fastener 12*b* is adjacent to the engaging portion 12*a* composed of the female surface fastener and has a predetermined length.

The belt connecting member 11 comprises a body 11*a* a whole shape of which is a rectangle with its ridges and four corners being chamfered. The body 11*a* is defined at an end thereof with an inserting hole 11*b*' constituting a fixing portion 11*b* for fixing the belt-shaped body 1*d* of the cap 1. The belt-shaped body 1*d* of the cap 1 is inserted through the inserting hole 11*b*' from a surface side, wound about an end edge portion of the body 11*a*, and folded toward a rear face side, and the folded end of the belt-shaped body 1*d* is sewn, thereby fixing the belt connecting member 11 to the cap 1.

Figure 6:
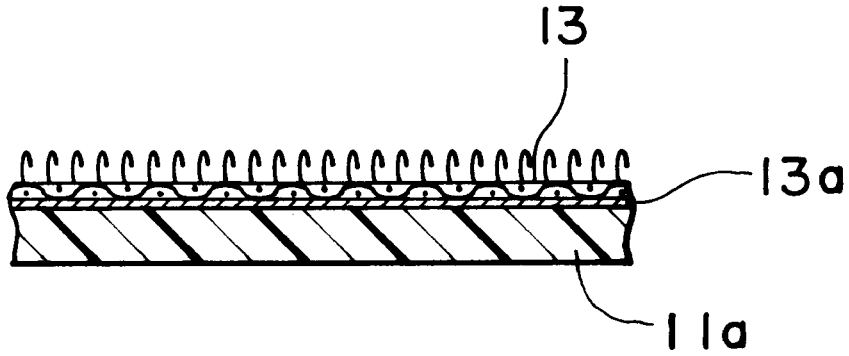
FIG. 6 is a fragmentary sectional view of a male surface fastener of a body of the belt connecting device.

The body 11*a* has on a surface of the other end thereof an engaged portion 11*c* with which the engaging portion 12*a* of the belt 12 detachably engages, and a belt threading portion 11*e* in a form of an elongated hole which is slightly longer than a width of the belt 12 is formed between the inserting hole 11*b*' and the engaged portion 11*c*. As shown in FIG. 5, the engaged portion 11*c* is composed of a male surface fastener having a large number of male engaging elements 11*d*, and the belt connecting member 11 including the engaged portion 11*c* is molded integrally by using synthetic resin in the first embodiment. As shown in FIG. 6, it is possible to bond a male surface fastener 13 woven or knitted into a woven or knitted fabric to the surface of the other end of the body 11*a* by using an adhesive 13*a* so as to form the engaged portion. Alternatively, the female surface fastener may be bonded to form the engaged portion. In such a case, the male surface fastener is employed as the engaging portion 12*a* of the belt 12.

The belt connecting device 10 with the above structure can be easily operated by only inserting the other end portion of the belt 12, which is not secured, through the belt threading portion 11*e* of the belt connecting member 11 from the rear side, folding said end portion toward the engaged portion 11*c* composed of the male surface fastener while adjusting the length, and engaging the engaging portion 12*a* composed of the female surface fastener with the engaged portion 11*c*. At this time, even if the end portion of the belt 12 extends to pass over the engaged portion 11*c* of the belt connecting member 11, because the male surface fastener 12*b* is secured to the belt 12 to be adjacent to the engaging portion 12*a* of the female surface fastener, the engaging portion 12*a* at the end portion can be engaged with the male surface fastener 12*b*. Therefore, the end portion can be prevented from hanging down, and an appearance is not spoiled, thereby providing the belt connecting device with an excellent design property.

Figure 7:
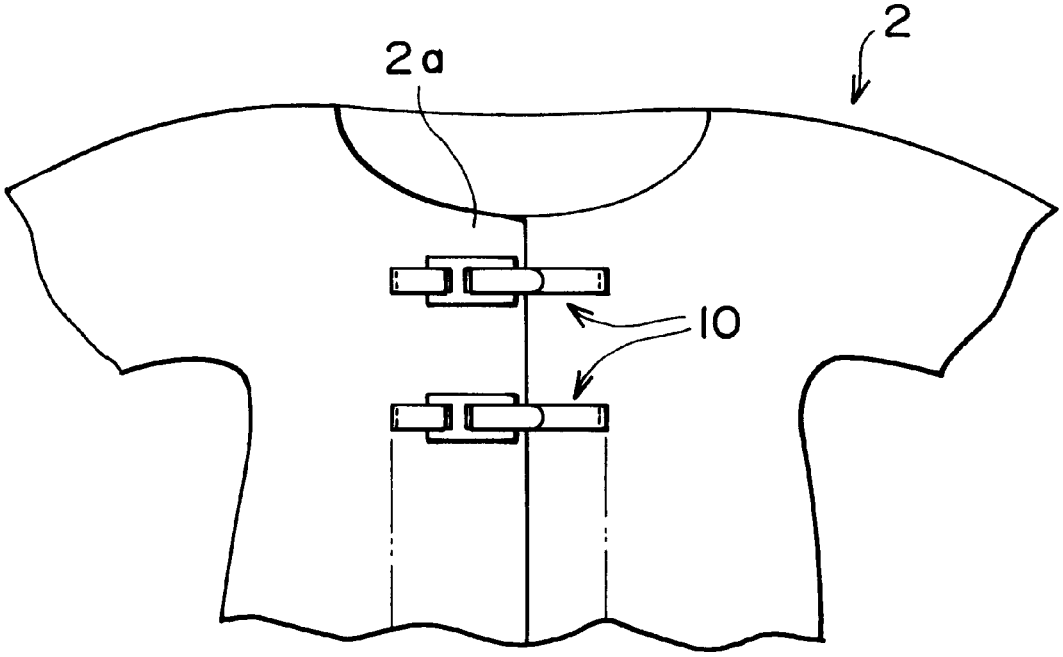
FIG. 7 is a front view of a suit of clothes to which the belt connecting devices according to the first embodiment of the invention are applied instead of buttons.

The belt connecting devices 10 can be used not only in the cap 1 but also in a fly portion 2*a* of a suit of clothes 2 instead of buttons as shown in FIG. 7, for example. In a case of the belt connecting device 10 applied to the fly portion 2*a* of the suit of clothes 2 or to the portion for adjusting the size of the opening of the cap 1 as in the first embodiment, because a large tensile force is not applied to the belt connecting device 10, a sufficient engaging force can be obtained for the engaging portion 12*a* of the belt 12 only by an engagement of the engaging portion 12*a* with the engaged portion 11*c* of the belt connecting member 11. Therefore, it is also possible to eliminate the male surface fastener 12*b* of the belt 12. However, in the belt connecting device employed for adjusting a length of a shoulder belt of a rucksack, for example, because a large tensile force is applied to the belt connecting device, the engaging strength of the engaging portion of the belt can be increased by engaging the engaging portion with both the engaged portion of the belt connecting member and the male surface fastener of the belt, thereby preventing disengagement of the connecting device.

Figure 8:
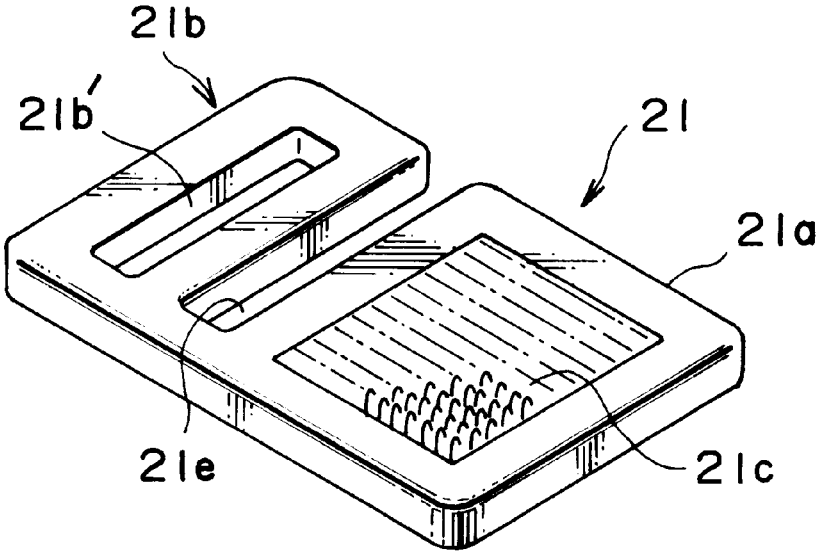
FIG. 8 is a perspective view of a belt connecting member of a belt connecting device according to a second embodiment of the invention.

FIG. 8 is a perspective view of a belt connecting member 21 in a belt connecting device according to a second embodiment of the invention. Because a belt in the belt connecting device is the same as that in the above-described first embodiment, a description of the belt will be omitted.

The belt connecting member 21 comprises a body 21*a* a whole shape of which is a rectangle with its ridges and four corners being chamfered, similarly to that in the first embodiment. The body 21*a* is defined at an end thereof with an inserting hole 21*b*', constituting a fixing portion 21*b*, through and to which a portion of an article is inserted and fixed. The body 21*a* is defined on a surface of the other end thereof with an engaged portion 21*c* composed of a male surface fastener with which an engaging portion of the belt composed of a female surface fastener can detachably engages. Furthermore, a belt threading portion 21*e* in a shape of an elongated hole with its one end being cut is formed between the inserting hole 21*b*' and the engaged portion 21*c*.

The belt connecting device as described above is connected by inserting the belt through the belt threading portion 21*e* of the belt connecting member 21 from the rear side to the surface side, folding back the belt, and engaging the engaging portion of the belt with the engaged portion 21*c* of the belt connecting member 21 while adjusting a length. At this time, because the belt threading portion 21*e* is in the shape of the elongated hole with its one end being cut, an operation of inserting the belt can be easily carried out, and even elderly people and infants can easily insert the belt in a short time.

Figure 9:
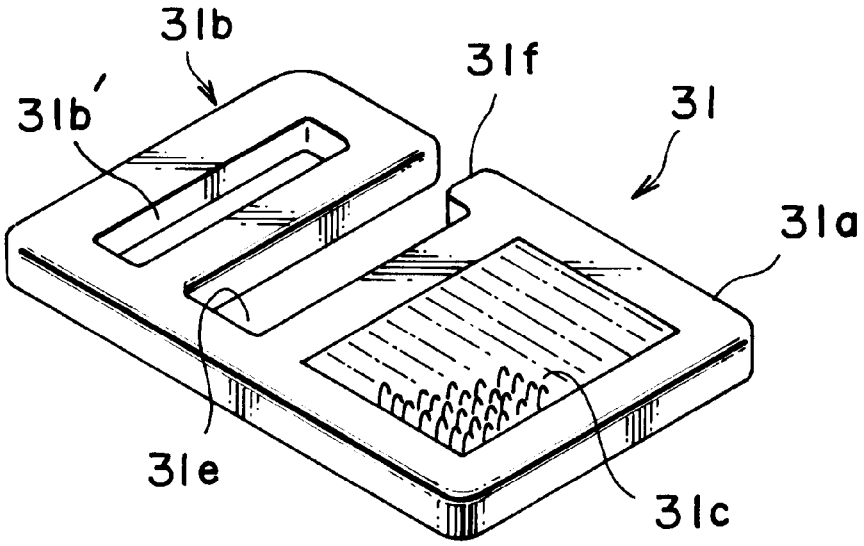
FIG. 9 is a perspective view of a belt connecting member of a belt connecting device according to a third embodiment of the invention.

FIG. 9 is a perspective view of a belt connecting member 31 in a belt connecting device according to a third embodiment of the invention. Because a belt in the embodiment is the same as that in the above-described first embodiment, a description of the belt will be omitted.

The belt connecting member 31 comprises a body 31*a* a whole shape of which is a rectangle with its ridges and four corners being chamfered. The body 31*a* is defined at one end thereof with an inserting hole 31*b*' constituting a fixing portion 31*b* to be fixed to an article, and on a surface of the other end of the body 31*a* with an engaged portion 31*c* comprising a male surface fastener. Between the inserting hole 31*b*' and the engaged portion 31*c*, a belt threading portion 31*e* in a shape of an elongated hole with one end thereof being cut is formed, and a projection 31*f* for preventing slipping off of the belt is formed to project from an edge of the cut end.

The belt connecting device as described above is connected by inserting the belt through the belt threading portion 31*e* of the belt connecting member 31 from a rear side toward a surface side, folding back the belt, and engaging the engaging portion of the belt with the engaged portion 31*c* of the belt connecting member 31 while adjusting a length. At this time, because the projection 31*f* for preventing slipping off of the belt is formed at the edge of the cut end of the belt threading portion 31*e*, the belt inserted through the belt threading portion 31*e* is effectively prevented from slipping off the threading portion 31*e*, thereby reliably carrying out the engagement.

Figure 10:
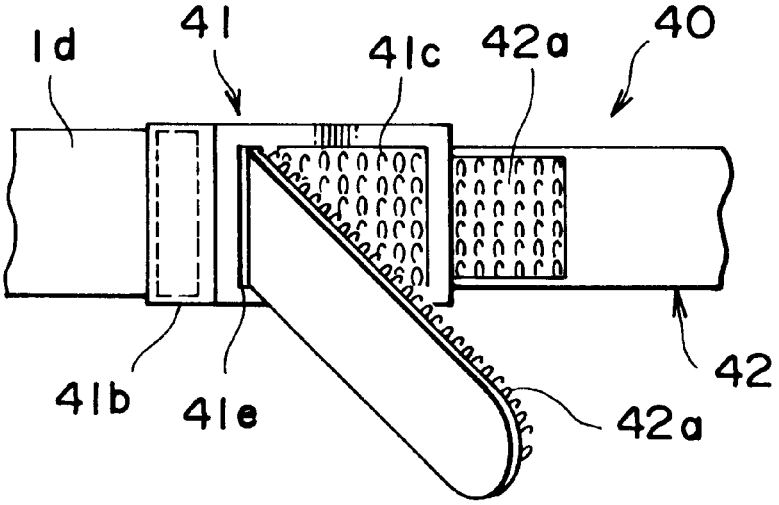
FIG. 10 is a front view of a belt connecting device according to a fourth embodiment of the invention.
Figure 11:
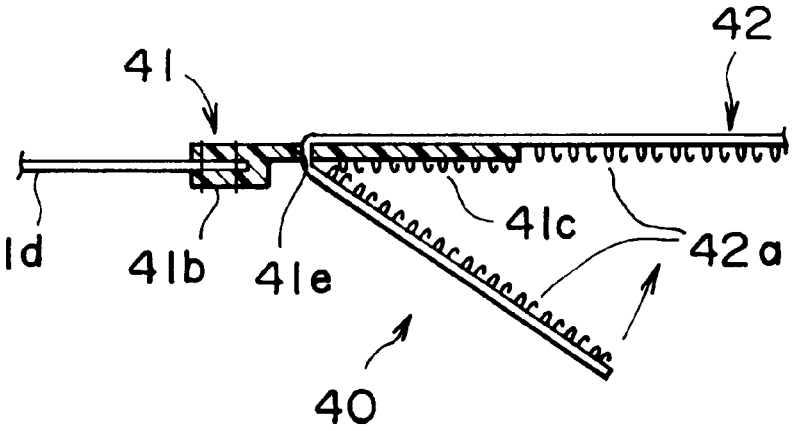
FIG. 11 is a sectional view of the connecting device of FIG. 10.
Figure 12:
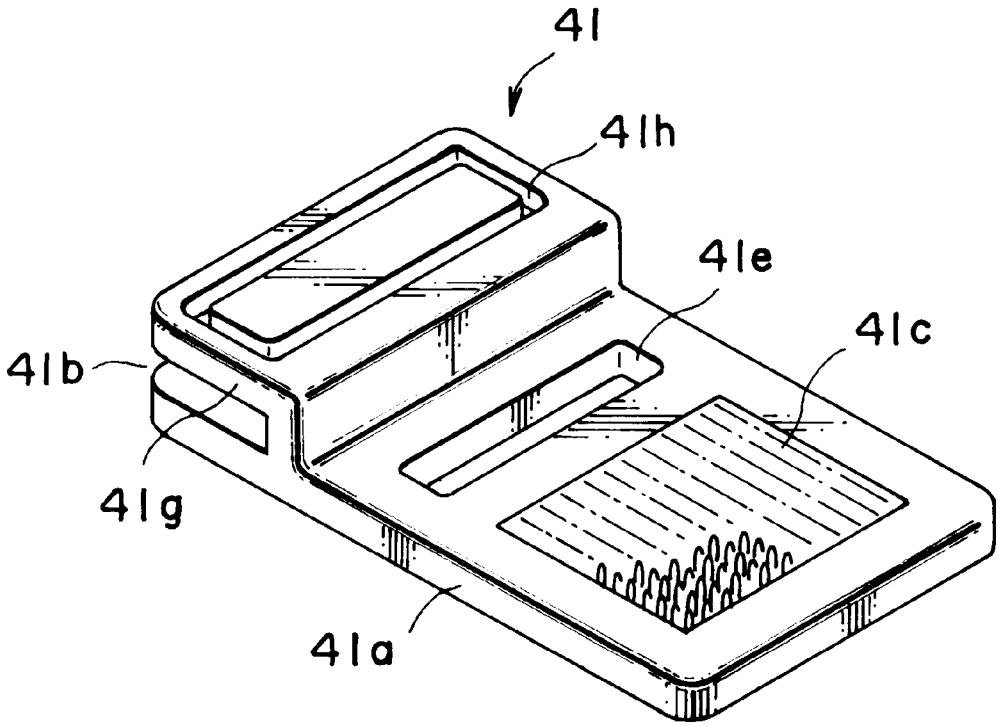
FIG. 12 is a perspective view of the belt connecting member of the belt connecting device of FIG. 10.

FIG. 10 is a front view of a belt connecting device according to a fourth embodiment of the invention, FIG. 11 is a sectional view of the connecting device, and FIG. 12 is a perspective view of a belt connecting member in the belt connecting device.

The belt connecting device 40 comprises a belt connecting member 41 fixed to the portion 1*d* of an article and a belt 42 fixed at an end portion thereof to another portion of the article by sewing. The belt 42 is defined with an engaging portion 42*a* which extends on a surface of the belt 42 from the other end portion opposite to the fixed end portion such that the engaging portion 42*a* has a predetermined length. The engaging portion 42*a* comprises a surface fastener wherein mixed male engaging elements and female engaging elements exist. The engaging portion 42*a* is integrally secured to the belt 42 by bonding by using an adhesive or by sewing. Alternatively, the surface fastener is woven or knitted into the belt 42 simultaneously with weaving/knitting of the belt 42, thereby integrally forming the engaging portion 42*a* simultaneously with weaving/knitting of the belt 42.

The belt connecting member 41 comprises a body 41*a* a whole shape of which is a rectangle with its ridges and four corners being chamfered. The body 41*a* is defined at one end thereof with a fixing portion 41*b* to be fixed to the article, and a surface fastener wherein mixed male engaging elements and female engaging elements exist and with which the engaging portion 42*a* of the belt 42 detachably engages is bonded by an adhesive to a surface of the other end of the body 41*a*, thereby forming an engaged portion 41*c*. Between the fixing portion 41*b* and the engaged portion 41*c*, a belt threading portion 41*e* in a shape of an elongated hole which is slightly longer than a width of the belt 42 is formed.

Figure 13:
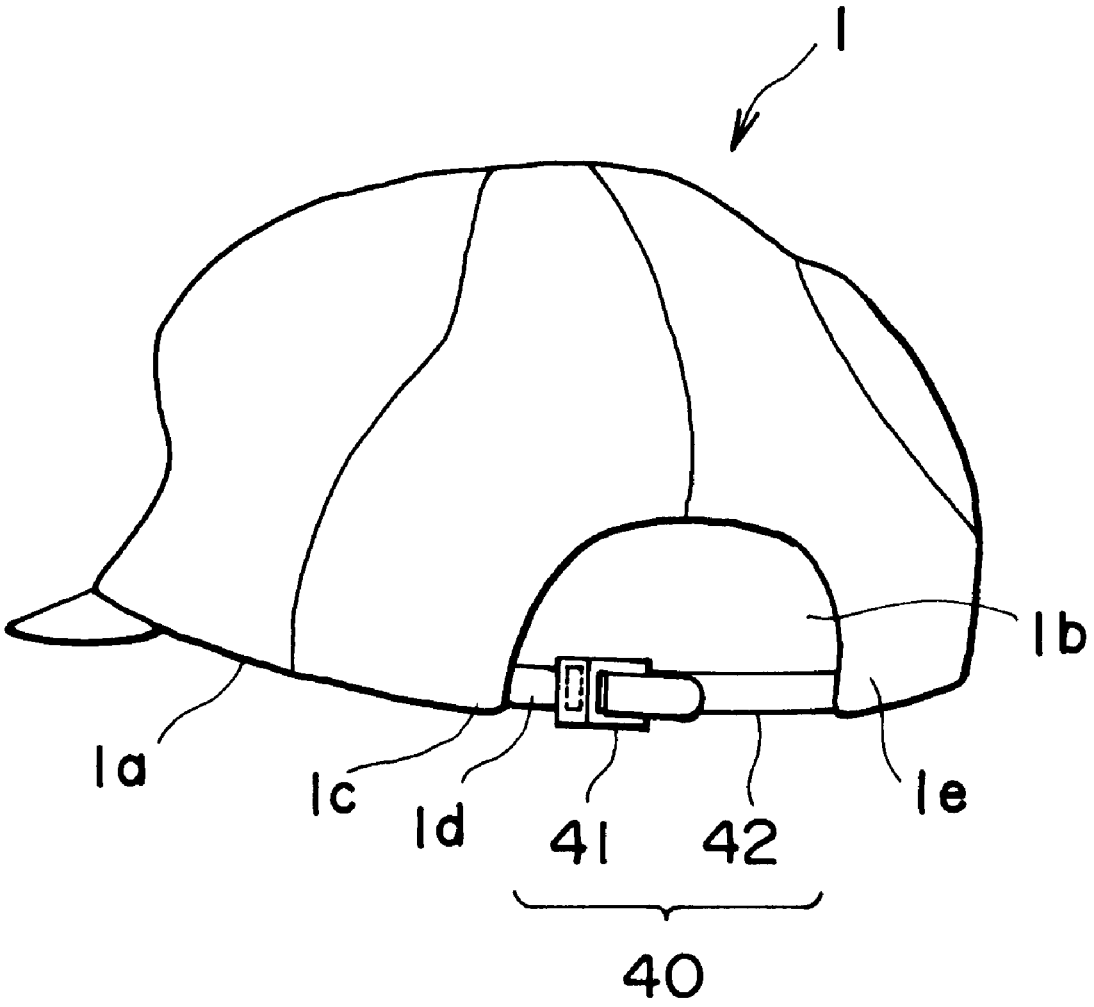
FIG. 13 is a rear view of a cap provided with the belt connecting device according to the fourth embodiment of the invention.
Figure 14:
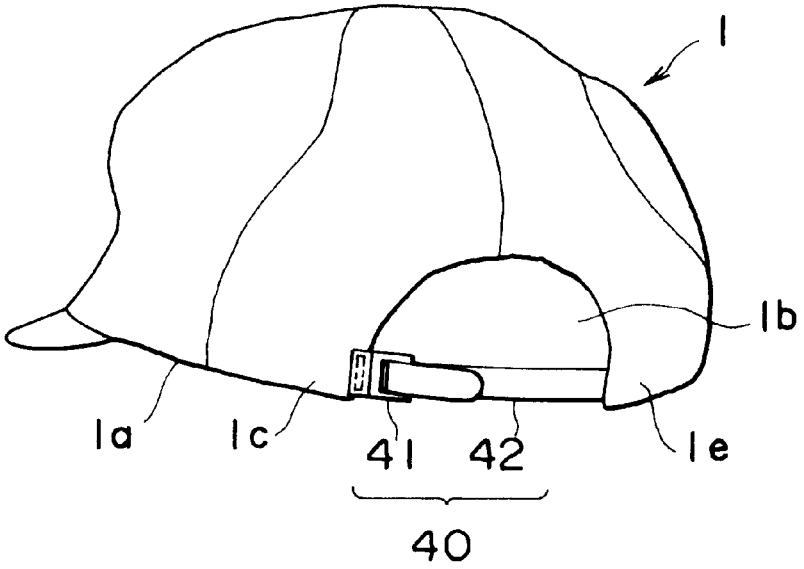
FIG. 14 is a rear view of another cap provided with the belt connecting device according to the fourth embodiment of the invention.

The fixing portion 41*b* comprises upper and lower clamping portions including a part of the body 41*a* and a projecting portion 41*g* which is formed to project from an upper face of the body 41*a* and is L-shaped in section. A portion of the article is clamped and fixed between the body 41*a* and the projecting portion 41*g*. Furthermore, a thin sewing recessed groove 41*h* is formed in an upper face of the projecting portion 41*g*, and the portion of the article clamped between the body 41*a* and the projecting portion 41*g* is fixed by sewing in the sewing recessed groove 41*h*. By employing the fixing portion 41*b* in the above shape, when the belt connecting device 40 is fixed to the window portion 1*b* of the cap 1, for example, as shown in FIG. 13, the belt-shaped body 1*d* is sewn on one corner portion 1*c* of the window portion 1*b* of the cap 1, and the belt-shaped body 1*d* is clamped and fixed by the fixing portion 41, thereby fixing the belt connecting member 41 to the cap 1. Alternatively, as shown in FIG. 14, the corner portion 1*c* of the cap 1 can be directly clamped by the fixing portion 41*b* to be sewn and fixed.

In the above described belt connecting device 40, because both the engaging portion 42*a* of the belt 42 and the engaged portion 41*c* of the belt connecting member 41 comprise the surface fasteners which can be engaged with and disengaged from each other and wherein mixed male and female engaging elements exist, a male or female surface fastener is not necessary to be especially selected to be mounted to the engaging portion and the engaged portion. If an end portion of the belt 42 extends to pass over the engaged portion 41*c* of the connecting member 41, because the end portion is engaged with and fixed to the engaging portion 42*a* of the belt 42, the end portion can be prevented from hanging down, and an appearance is not spoiled. Also, because an embossed pattern or design can be printed on the upper face of the projecting portion 41*g* constituting the fixing portion 41*b* of the belt connecting member 41, various designs can be applied to the device.

Figure 15:
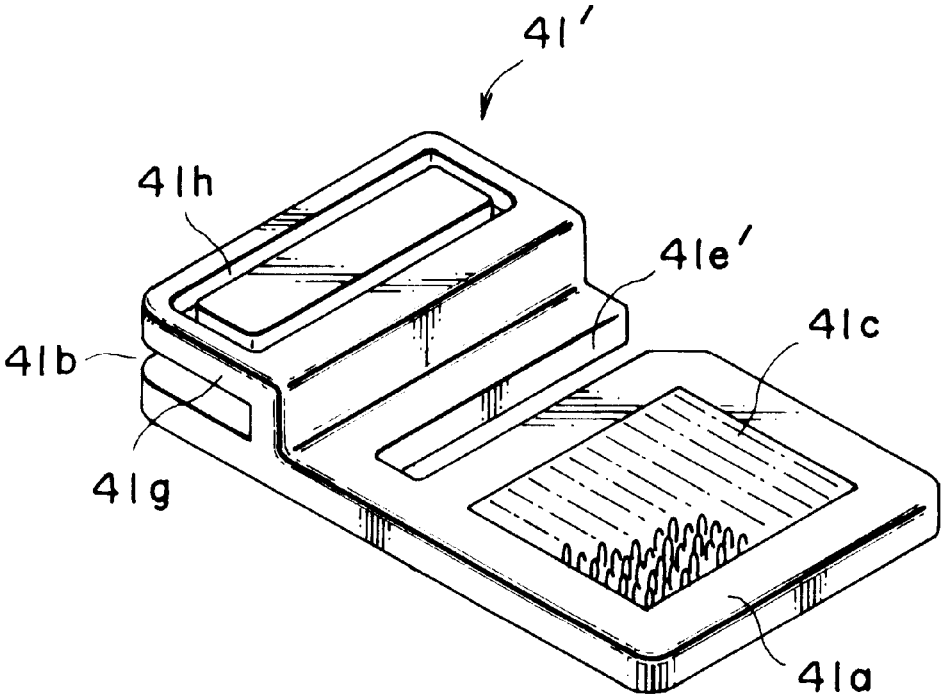
FIG. 15 is a perspective view of a belt connecting member as a modification of the fourth embodiment of the invention.

Furthermore, like in a belt connecting member 41' shown in FIG. 15, a belt threading portion 41*e*' may be in a shape of an elongated hole with an end thereof being cut. Moreover, by diagonally chamfering a corner portion of an edge of the cut end, the belt can be further easily inserted.

As is apparent from the above descriptions, the belt connecting device of the present invention can be operated only by inserting the belt 12 through the belt threading portion 11*e*, 21*e*, 31, 41*e* of the belt connecting member 11, 21, 31, 41, folding back the belt 12, and engaging the engaging portion 12*a*, 42*a* of the belt 12 with the engaged portion 11*c*, 21*c*, 31, 41*c* of the belt connecting member 11, 21, 31, 41 while adjusting the length. Therefore, the device can be operated easily and safely, and even the elderly people and infants can easily operate the device. Also, a design property of the device is excellent, and the device can be applied to various uses such as an adjuster for adjusting the size of the opening of the cap or glove, a waist adjuster, and a substitute for a button used in the fly portion of clothes.

What is claimed:

1. A belt connecting device for adjustably connecting one portion of an article to a belt having one belt end portion fixed to another portion of the article, the belt having another belt end portion having an engaging portion, the belt connecting device comprising:

a belt connecting member having a fixing portion at one end, the fixing portion adapted to be fixed to the one portion of the article;

the belt connecting member having an engaged portion at another end and rigidly connected to the fixing portion, the engaged portion adapted to be detachably engaged with the engaging portion of the belt; and the belt connecting member having a belt threading portion between the fixing portion and the engaged portion.

2. A belt connecting device according to claim 1, wherein the belt threading portion is an elongated hole which is slightly longer than a width of the belt.

3. A belt connecting device according to claim 1, wherein the belt threading portion is in a shape of an elongated hole with one end thereof being cut off.

4. A belt connecting device according to claim 3, wherein a projection for preventing slipping off of the belt is formed at an edge of a cut end of the elongated hole.

5. A belt connecting device according to claim 1, wherein the fixing portion has an inserting hole through which the one portion of the article can be inserted.

6. A belt connecting device according to claim 1, wherein the fixing portion comprises upper and lower clamping portions for clamping and fixing the one portion of the article.

7. A belt connecting device according to claim 6, wherein the fixing portion has a thin recessed groove for sewing.

8. A belt connecting device according to claim 1, wherein each of the engaging portion and the engaged portion comprises a male or female surface fastener such that the engaging portion and the engaged portion can be engaged with and disengaged from each other.

9. A belt connecting device according to claim 8, wherein the belt has either the male or female surface fastener which can be engaged with and disengaged from the engaging portion and which is the same kind of fastener as the engaged portion, said male or female surface fastener being adjacent to the engaging portion.

10. A belt connecting device according to claim 8, wherein each of the engaging portion and the engaged portion comprises a surface fastener where mixed male and female engaging elements exist, said male and female engaging elements engaging with and disengaging from each other.

11. A belt connecting device according to claim 8, wherein the engaged portion of the belt connecting member comprises a male surface fastener, and the belt connecting member including said engaged portion is integrally molded by using synthetic resin.

12. A belt connecting device according to claim 8, wherein the engaged portion of the belt connecting member and the engaging portion of the belt comprise surface fasteners woven/knitted into woven/knitted fabrics.

13. A belt connecting device according to claim 1, wherein the engaged portion of the belt connecting member is a surface fastener.

14. A belt connecting device according to claim 1, wherein the engaged portion is provided on only one side of the belt connecting member.

15. A belt connecting device for adjustably connecting one portion of an article to a belt fixed to another portion of the article, the belt having an engaging portion, the belt connecting device comprising:

a fixing portion adapted to be fixed to the one portion of the article;

a surface fastener portion rigidly connected to the fixing portion and adapted to be detachably engaged with the engaging portion of the belt; and a belt threading portion positioned relative to the surface fastener engaged portion such that the surface fastener engaged portion can be detachably engaged with the engaging portion of the belt.

16. A belt connecting device according to claim 15, wherein the surface fastener portion is provided on only one side of the belt connecting device.

* * * * *